United States Patent [19]

MacDonald

[11] Patent Number: 4,711,629

[45] Date of Patent: Dec. 8, 1987

[54] FLARE STACK IGNITOR

[76] Inventor: Roderick J. MacDonald, #8, Site 14, R.R. #1, Red Deer, Alberta, Canada, T4N 5E1

[21] Appl. No.: 758,689

[22] Filed: Jul. 25, 1985

[30] Foreign Application Priority Data

Jan. 8, 1985 [CA] Canada ..... 471702

[51] Int. Cl.[4] ..... F23Q 3/00

[52] U.S. Cl. ..... 431/264; 431/202; 313/30

[58] Field of Search ..... 431/202, 263, 264, 266; 313/30, 120, 231.41

[56] References Cited

U.S. PATENT DOCUMENTS

| | | | |
|---|---|---|---|
| 223,790 | 1/1880 | Winters | 313/30 |
| 1,307,894 | 6/1919 | Blomster et al. | 313/120 X |
| 1,327,382 | 1/1920 | Garber | 313/120 X |
| 2,459,286 | 1/1949 | Rabezzana et al. | 313/30 X |
| 2,625,921 | 1/1953 | Van Ry | 313/120 X |
| 2,701,324 | 2/1955 | Peroutky et al. | 313/30 |
| 2,733,385 | 1/1956 | Bychinsky | 313/30 X |
| 3,316,437 | 4/1967 | Weins | 313/120 |
| 4,147,493 | 4/1979 | Straitz | 431/202 X |
| 4,232,242 | 11/1980 | Hsu | 313/120 |
| 4,513,220 | 4/1985 | Togashi | 313/120 |

FOREIGN PATENT DOCUMENTS

| | | | |
|---|---|---|---|
| 142741 | 5/1920 | United Kingdom | 313/120 |

*Primary Examiner*—Carroll B. Dority, Jr.
*Attorney, Agent, or Firm*—Harold H. Dutton, Jr.; George H. Dunsmuir

[57] ABSTRACT

An ignitor for burning sour oil field gas includes a pair of electrodes which are spaced apart at one end and a source of electrical power for causing arcing between the free ends of the electrodes. In order to ensure a good supply of air to the area of arcing a venturi is provided on each electrode for drawing air into the hollow electrode. The venturi includes a central tube for alignment with the hollow electrode and radially extending tubes for introducing air into the central tube.

1 Claim, 6 Drawing Figures

FLARE STACK IGNITOR

BACKGROUND OF THE INVENTION

This invention relates to an ignitor and in particular to an electrode device for use on a stack for burning sour oil field gas.

Flare stack ignitors are described in detail in the patent literature. Examples of such ignitors are found in U.S. Pat. No. 3,756,765 issued to D. H. Sparrow et el on Sept. 4, 1973; U.S. Pat. No. 3,797,991 issued to J. F. Straitz III issued on Mar. 19, 1974; U.S. Pat. No. 3,833,336 issued to W. L. Ray on Sept. 3, 1974 and U.S. Pat. No. 4,147,493 issued to R. R. Clarke on Apr. 3, 1979. In all cases it is important to ensure ignition and to maintain combustion of the gases emitted from the flare stacks. Ignition and combustion are ensured only by constantly maintaining a good supply of oxygen to the ignitor. The devices described in the above mentioned patents are more or less successful in this respect.

The present inventor has found that a need still exists for an electrode device for an ignitor which ensures a good supply of oxygen to the spark or arc area of the ignitor.

BRIEF SUMMARY OF THE INVENTION

Accordingly the present invention relates to an electrode device for a gas ignitor comprising hollow, elongated, electrically conductive body means for use in spaced apart relationship to similar body means for causing arcing between one end of each said body means and the other said body means; and venturi means for drawing air into the other end of said body means for ensuring an adequate supply of oxygen to said one end.

BRIEF DESCRIPTION OF THE DRAWINGS

The invention will now be described in greater detail with reference to the accompanying drawings which illustrate a preferred embodiment of the invention and wherein.

DESCRIPTION OF THE PREFERRED EMBODIMENT(S)

Figure 1:
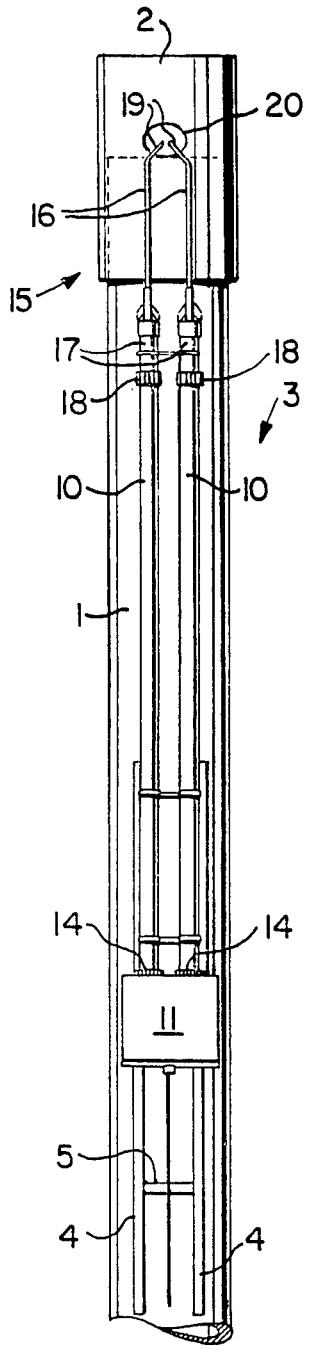
FIG. 1 is a front elevation view of a flare stack and ignitor incorporating the electrode device of the present invention.
Figure 2:
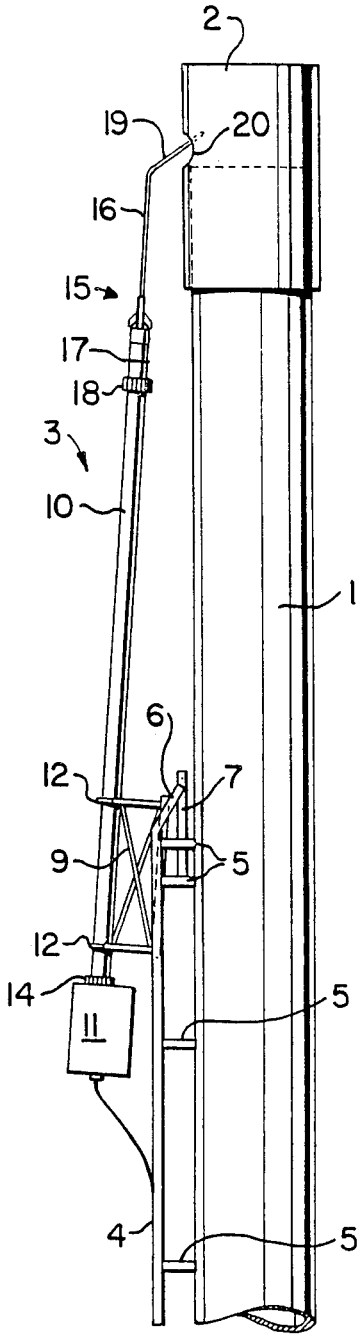
FIG. 2 is a side elevation view of the flare stack ignitor of FIG. 1.

With reference to FIGS. 1 and 2, a flare stack ignitor is intended for use on a tubular flare stack 1 of the type normally used to discharge sour gas from a well. Sour gas is discharged from a cylindrical wind deflector 2 at the top end of the stack 1 and is ignited by an ignitor generally indicated at 3. The ignitor 3 is permanently installed on new stacks during installation or added to existing stacks.

The ignitor 3 includes a pair of parallel tracks 4 extending upwardly from close to the ground (not shown) to close to the top of the stack 1. The tracks 4 are connected to the stack 1 by generally U-shaped arms 5. Appropriate electrical insulators (not shown) are provided between the arms 5 and the stack 1. The upper ends 6 of the tracks 4 bend inwardly towards the stack 1 and a stop 7. The structure defined above is essentially the same as the structure described in applicant's copending Canadian Patent Application Serial Number 487,140-5 filed July 19, 1985, which is a division of Canadian patent application Ser. No. 413,042.

A carriage 9 is slidably mounted on the tracks 4 for movement up the stack 1 to the ignition position shown in FIGS. 1 and 2. The carriage 9 is a skeletal, rectangular frame for supporting a pair of elongated, parallel tubes 10 and an ignition casing 11. The tubes 10 are connected to the carriage 9 by U-shaped brackets 12. A cable 14 carries electrical power to the casing 11. The casing 11 is connected to the tubes 10 by couplers 14. The tubes 10 contain conductors (not shown) for conducting electrical power to a pair of electrode devices generally indicated at 15 mounted on the top ends of the tubes 10.

The electrode devices 15 are defined by tubular, electrically conductive bodies 16 and venturi 17. The venturi devices 17 are connected to the tubes 10 by couplers 18. The top ends 19 of the bodies 16 bend inwardly and towards each other for defining a small gap where arcing can occur. In use the top ends 19 of the bodies 16 extend through an opening 20 into the wind deflector 2.

Figure 3:
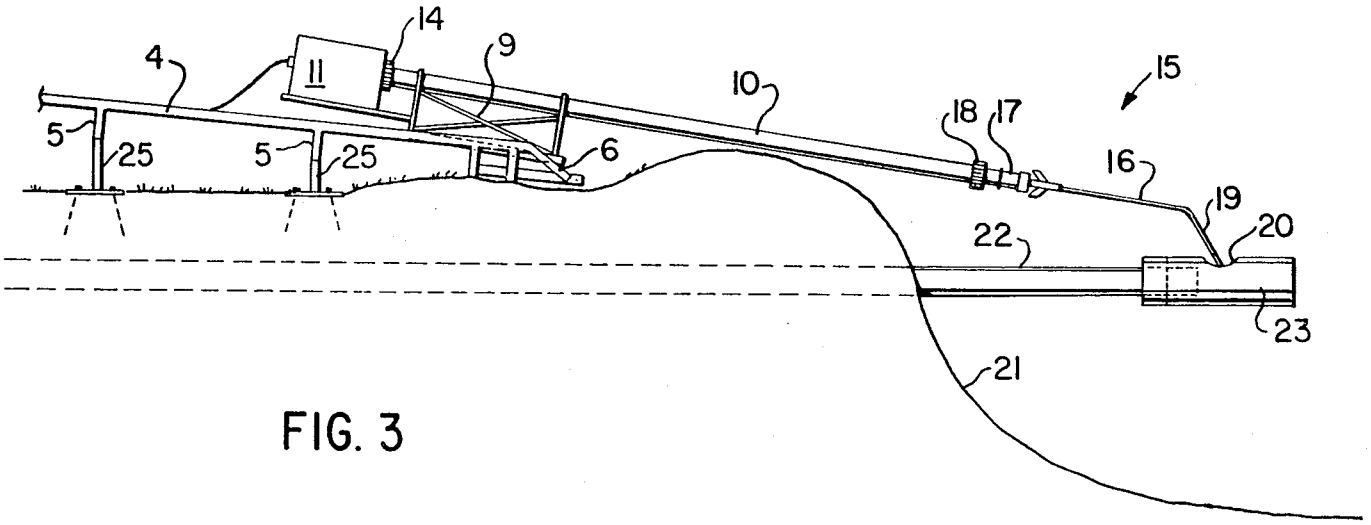
FIG. 3 is a side elevation view of a so-called pit ignitor incorporating the electrode device of the present invention.

The ignitor of FIG. 3 is identical to that of FIGS. 1 and 2 except that it is used in a pit 21. Gas is introduced into the pit 21 through a pipe 22 similar to the stack 1 and a wind deflector 23. The tracks 4 of the ignitor are mounted on legs 25 so that tubes 10 and the electrodes 15 are inclined downwardly into the pit, the ends 19 of the bodies 16 extend into the wind deflector 23.

Figure 4:
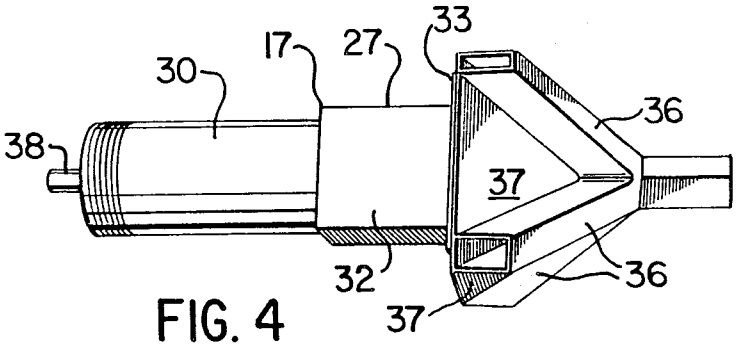
FIG. 4 is a perspective view of a venturi for use in the device of FIGS. 1 to 3.
Figure 5:
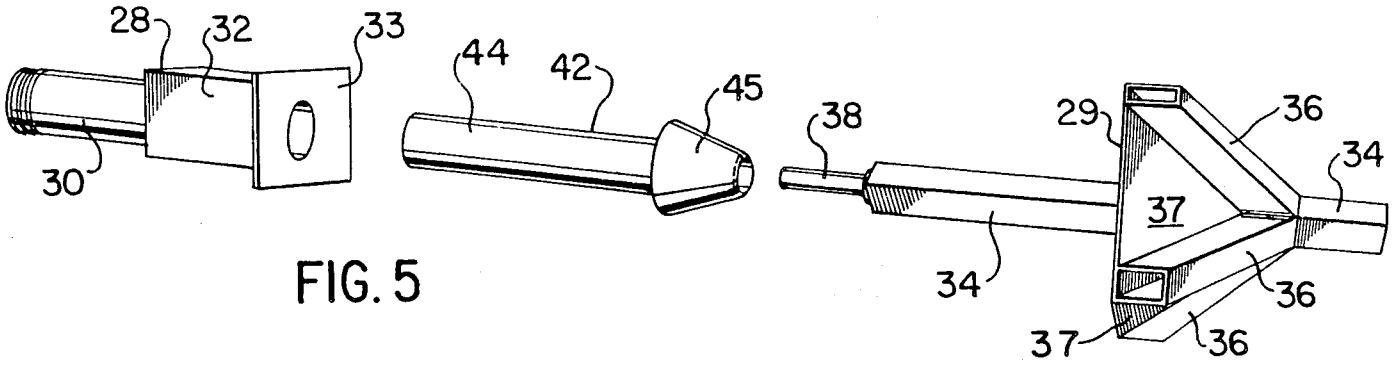
FIG. 5 is an exploded, perspective view of the venturi of FIG. 4.

Referring to FIGS. 4 and 5 the venturi 17 used to ensure an adequate supply of air to the area of the arc at the top end of each electrode 15 includes a casing 27 defined by lower and upper sections 28 and 29 respectively. The bottom casing section 28 includes an externally threaded, cylindrical lower end 30 for mounting on a tube 10 and a hollow rectangular upper end 32 with a rectangular cover 33 thereon. The upper casing section 29 is defined by a central rectangular duct 34 with four rearwardly inclined, radially extending rectangular ducts 36 attached thereto. Plates 37 extend between the ducts 36 for defining a cowl, giving structural strength to the upper casing section 29. A smaller diameter, internally threaded, hexagonal coupler 38 extends downwardly from the bottom end of the duct 34 for receiving the electrical lines extending upwardly through the duct 10. In producing the upper casing section 29 the ducts 36 are welded to each other and to plates 37 near the top end of the rectangular duct 34. Holes (not shown) are provided in the duct 34 in alignment with the ducts 36. Thus during combustion in the area of the upper end of the electrode bodies 16, a partial vacuum is created and air is drawn through the ducts 36 and 4 and through the hollow bodies 16 to the combustion area.

The casing sections 28 and 29 are assembled with an insulator 42 therebetween. The insulator 42 includes a cylindrical tube 44 for sliding into the casing section 28 and a frusto-conical head 45 for resting on the cover 33. The duct 34 and the coupler 38 are inserted into the insulator 42 so that the coupler 38 extends a short distance out of the cylindrical end 44. The coupler 38 connects the conductor in the tube 10 to the electrode body 16. When the venturi 17 is assembled, the tube 44 and head 45 separate the casing sections 28 and 29 so that electrical current passes through the casing section 29 only to the electrode body 16.

Figure 6:
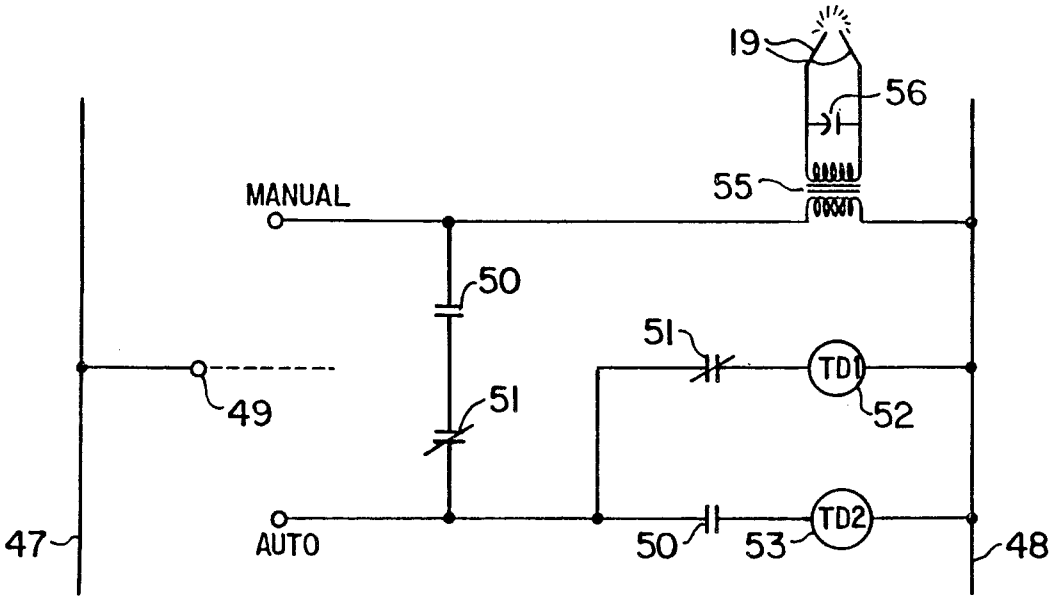
FIG. 6 is a schematic diagram of an electrical control circuit used with the ignitor of FIGS. 1 to 4.

The control circuit (FIG. 6) for operating the ignitor, includes electrical power lines 47 and 48, a switch 49 for placing the ignitor on manual or automatic control, capacitors 50 and 51, timer 52 and 53, a transformer 55 and a capacitor 56. The capacitors 50 and 51 define first and second relays for interrupting or transmitting power to the transformer 55. The timer 52 controls the time delay between arcing and the timer 52 controls the duration of the arcing. With the switch 49 on manual, arcing is continuous. With the switch 49 on automatic electrical power is supplied to the timer 52 through one pole of the timer 53. After a delay established by the setting of the timer 52 the first relay (capacitors 50) closes to energize the timer 53 and the transformer 55. After a delay established by the setting of the timer 53 the second relay (capacitors 51) closes to de-energize the first relay. Thus the flow of current is interrupted to de-energize the transformer 55 and the second relay. The cycle is then repeated so that arcing at the top ends 19 of the electrode bodies 16 occurs continuously at regular predetermined intervals. Arcing occurs for an interval of time established by the setting of the timer 52. The duration of the arcing is determined by the setting of the timer 53. During combustion in the area of the gap between the electrode devices 15, air is drawn through the venturi 17 and the electrode bodies 16 to support such combustion.

What I claim is:

1. A flare stack ignitor comprising a pair of hollow elongated electrodes movably mounted on a flare stack, each of said electrodes including venturi means comprising a casing member having a hollow upper section telescopically mounted in a hollow lower section, an electrical insulator between said upper and lower sections for electrically isolating said sections, said lower section including means for securing said casing to a support, said upper section having an open upper end and including means for connecting said upper section to an electric circuit for generating a spark between said electrodes, said upper section further including a venturi member having a central axial duct portion axially aligned in said upper section and a plurality of radially spaced radially extending duct portions inclined downwardly and away from said upper section for drawing combustion air into said central axial duct portion and conveying said air to the open upper end of said upper section, said electrodes being so connected to said electric circuit and so positioned with respect to each other as to create a spark therebetween for igniting gases in said flare stack.

* * * * *